US005779458A

United States Patent [19]

Hong et al.

[11] Patent Number: 5,779,458

[45] Date of Patent: Jul. 14, 1998

[54] VALVE APPARATUS OF ENCLOSED RECIPROCATING COMPRESSOR

[75] Inventors: Myung-Jung Hong; Ju-Hwan Kim, both of Suwon, Rep. of Korea

[73] Assignee: Samsung Electronics Co., Ltd., Suwon, Rep. of Korea

[21] Appl. No.: 710,186

[22] Filed: Sep. 12, 1996

[51] Int. Cl.[6] ..... F04B 21/02

[52] U.S. Cl. ..... 417/569; 137/527

[58] Field of Search ..... 417/566, 569, 417/571; 137/527, 856

[56] References Cited

U.S. PATENT DOCUMENTS

| | | | |
|---|---|---|---|
| 5,209,260 | 5/1993 | Baek | 417/569 |
| 5,328,338 | 7/1994 | Hirano et al. | 137/527 |

FOREIGN PATENT DOCUMENTS

| | | | |
|---|---|---|---|
| 90/15276 | 12/1990 | WIPO | 417/571 |

*Primary Examiner*—Charles G. Freay

*Attorney, Agent, or Firm*—Burns, Doane, Swecker & Mathis, L.L.P.

[57] ABSTRACT

In a reciprocating compressor, a piston reciprocates to compress a gas, and the compressed gas communicates with a discharge opening formed in a valve plate to force open a discharge valve apparatus mounted on the valve plate. The discharge valve apparatus includes a discharge valve and a stopper disposed behind the discharge valve. The discharge valve includes a fixing or anchoring portion and a movable portion which is flexibly movable relative to the fixing portion for opening and closing the discharge opening. The stopper limits the opening angle that can be achieved by the movable portion of the valve. The stopper forms a corner that bears against the valve. The corner extends at an oblique angle relative to a longitudinal axis of the valve in order to attenuate vibration in the movement portion of the valve before it reaches the fixing portion, thereby stabilizing the valve.

3 Claims, 5 Drawing Sheets

VALVE APPARATUS OF ENCLOSED RECIPROCATING COMPRESSOR

BACKGROUND OF THE INVENTION

1. Field of the Invention

The present invention relates to a valve apparatus of an enclosed reciprocating compressor which includes a stopper valve arranged to stabilize movement of a discharge valve.

2. Description of the Prior Art

A conventional enclosed reciprocating compressor includes, as illustrated in FIG. 1, driving means 20 having a rotor 21 and a stator 22 disposed at an upper side of a chamber formed by an upper and a lower case 10 and 11, a crank shaft 40 having an eccentric unit 41 disposed at a lower side of the rotor 21 through the medium of a bearing 30, and an oil pickup tube 50 disposed at a lower end of the eccentric unit 41 for being eccentrically moved by the turning effect of the crank shaft 40 and for picking up oil (o) stored in the lower case 11 to thereby supply the oil to the eccentric unit 41 and to a spiral groove 42 formed in the crank shaft 40.

The eccentric unit 41 of the crank shaft 40 is provided with a connecting rod 60 for receiving an eccentric movement according to the turning effect of the crank shaft 40 to thereby convert the movement to horizontal reciprocating movement.

The connecting rod 60 is provided at a tip end thereof with a piston 80 for moving horizontally reciprocally in a cylinder block 70 mounted in the lower case 11.

The cylinder block 70 is arranged at one side thereof with a cylinder head 90 having suction and discharge chambers 91 and 92 for enabling high pressurized gas to be sucked in and discharged therethrough.

Furthermore, the suction chamber 91 is provided at one side thereof with a silencer 100 for attenuating noise generated in the course of mixed gas being sucked in, and is arranged at the other side thereof with a capillary tube 110 for supplying the oil (o) stored in the lower case 11 to the suction chamber 91 when a piston 80 reciprocates in the cylinder block 70.

Meanwhile, as illustrated in FIGS. 2 and 3 a discharge valve plate 120 having a suction inlet 121 is disposed between the cylinder block 70 and the cylinder head 90.

A suction valve plate 130 is disposed between the cylinder block 70 and the discharge valve plate 120 for being opened by pressure generated by the high pressurized gas sucked from the suction chamber 91 to the cylinder block 70 when the piston 80 is moved to a bottom dead center.

Gaskets 140 are respectively provided between the cylinder head 90 and the valve plate 120 and between the cylinder block 70 and the suction valve 130.

At this time, the valve plate 120 is formed at an upper center area thereof with a first accommodation recess 122 for accommodating a keeper member 170 to accurately place a discharge valve 150 and a stopper valve 160 at a predetermined position.

A second accommodation recess 123 supports the discharge valve 150 for being opened by pressure generated by the high-pressurized gas discharged from the cylinder block 70 to the discharged chamber 92 when the piston 80 is moved to an upper dead point. The recess 123 also supports the stopper valve 160 behind the discharge valve 150.

The second accommodation recess 123 includes a support space **123*b* centrally formed with a discharge hole 124 for discharging the high pressurized gas from the cylinder block 70 to the discharge chamber 92**.

The second accommodation unit 123 includes at one end thereof a support groove **123*a* for accommodating respective valve fixing units 151 and 161 formed at tip ends of the discharge valve movement units 152 and 162**.

At this time, the stopper valve 160 is formed with a corner 163 between the valve fixing unit 161 and the valve movement unit 162. The unit 162 is bent upwardly at a predetermined angle so as to limit an opening angle of the discharge valve 150 and to alleviate trembling of the discharge valve 150. The corner 163 extends perpendicularly to a longitudinal axis A of the discharge valve 150 as viewed in a direction parallel to the opening 124 (see FIG. 2).

The bend unit 163 serves to press on an upper surface of the discharge valve 150 by way of a line contact to bias the valve movement unit 162 to a horizontal state as illustrated in FIG. 3.

The valve fixing unit 161 and the valve movement unit 162 are by the keeper member 170, so that the bend unit 163 line-contacts the valve at a junction between the valve fixing unit 151 and the valve movement unit 152, and the line-contact has no component in a direction parallel to the axis A.

At this time, when the high-pressurized gas is discharged, the discharge valve 150 is caused to open by pressure of discharged high-pressurized gas, which is in turn discharged to the discharge chamber 92 of the cylinder head 90.

The stopper valve 160 serves to limit the opening angle of the movement unit 152 of the discharge valve 150 and press down the fixing unit 151 of the discharge valve 150 as the corner 163 line-contacts the upper surface of the discharge valve 150, so that, when the pressurized gas is discharged through the discharge hole 124 of the valve plate 120, vibration of the discharge valve 150 tends to be alleviated.

However, there is a problem in the valve apparatus thus constructed, in that, the corner 163 of the stopper valve is perpendicular to the axis A and spaced by distance S from the step **123*c*, whereby the vibration of the valve movement 152 is transmitted to the valve fixing unit 151 for the generation of a vibration mode, therein and creating irregular movement of the discharge valve 150** and resulting in decreased performance and increased noises.

SUMMARY OF THE INVENTION

Accordingly, the present invention is provided to solve the aforementioned problems and it is an object of the present invention to provide a valve apparatus of an enclosed reciprocating compressor by which a contact characteristic between the stopper valve and discharge valve is such that a point-contact therebetween is realized obliquely to further stabilize the movement of the discharge valve, improve performances and to reduce the noise therefrom.

In accordance with the object of the present invention, there is provided a valve apparatus of an enclosed reciprocating compressor having a discharge valve, a stopper valve and a keeper member, the discharge valve adapted for opening and closing a discharge hole of a valve plate.

The stopper valve is formed with a bend unit or corner oriented obliquely relative to a longitudinal axis of the discharge valve, so that vibration of a valve movement unit of the discharge valve caused by discharge of the compressed high-pressurized gas cannot be transferred to a valve fixing unit.

BRIEF DESCRIPTION OF THE DRAWINGS

For a fuller understanding of the nature and objects of the invention, reference should be made to the following detailed description taken in conjunction with the accompanying drawings in which:

FIG. 11 is a top plan view of the stopper valve and discharge valve shown in FIG. 6.

DETAILED DESCRIPTION OF A PREFERRED EMBODIMENT OF THE INVENTION

Figure 1:
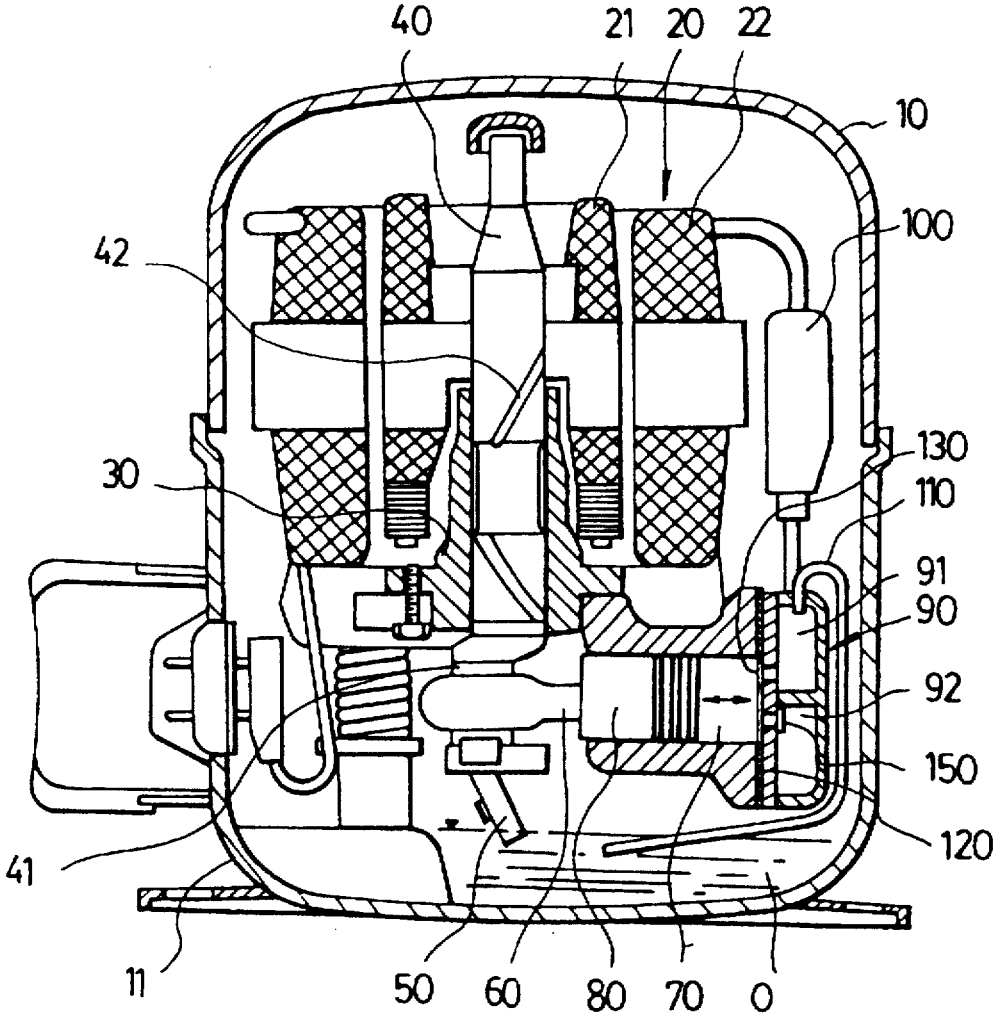
FIG. 1 (PRIOR ART)
FIG. 1 is a sectional view of a conventional enclosed compressor.
Figure 2:
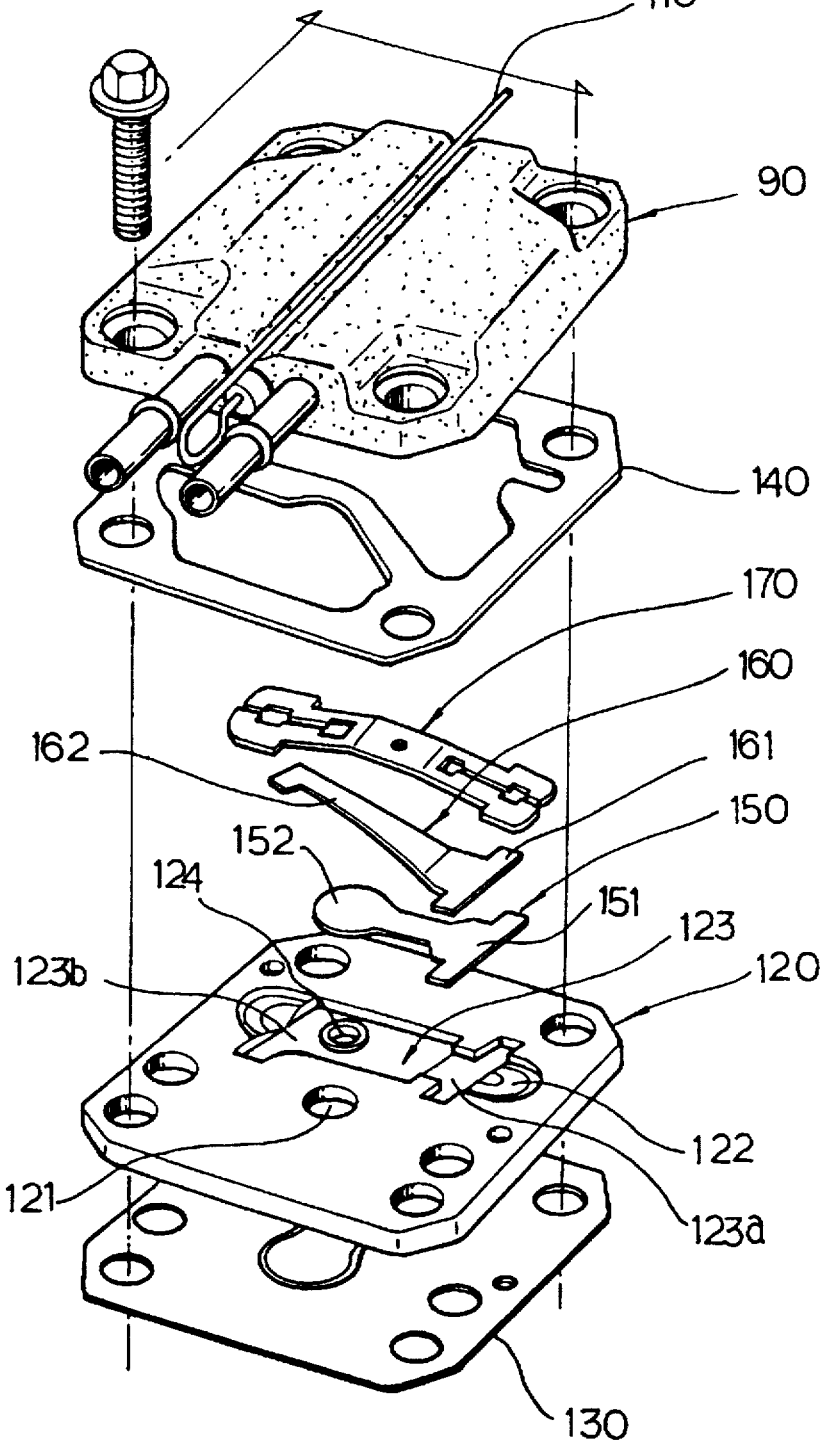
FIG. 2 (PRIOR ART)
FIG. 2 is an exploded perspective view for illustrating a conventional cylinder head.
Figure 3:
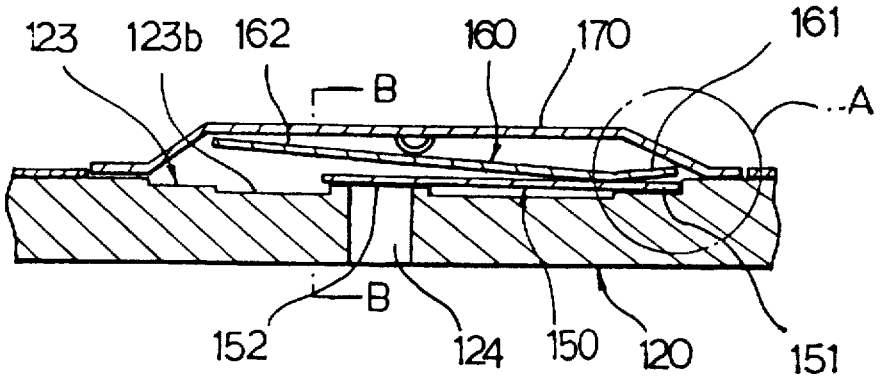
FIG. 3 is an assembled sectional view for illustrating the conventional cylinder head.
Figure 4:
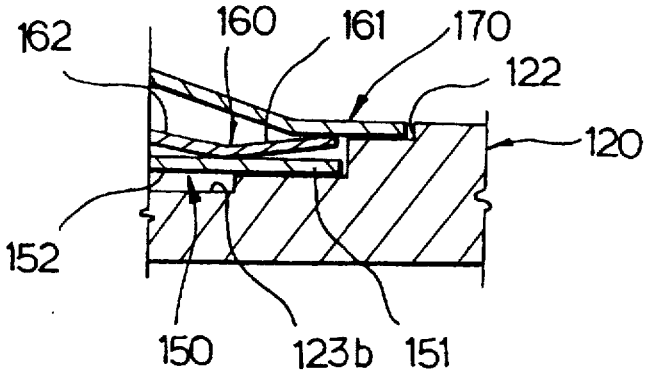
FIG. 4 is an enlarged schematic drawing of section "A" in FIG. 3.
Figure 5:
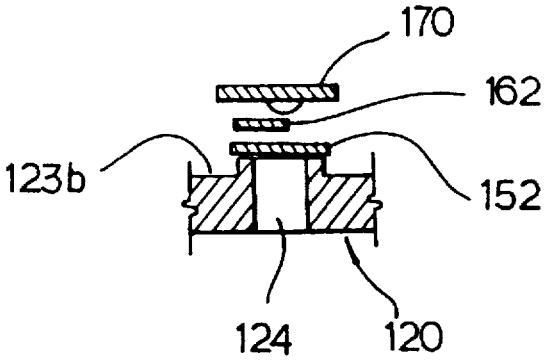
FIG. 5 is a sectional view taken along line 5—5 in FIG. 3.

Now, the preferred embodiment of the present invention will be described in detail with reference to the accompanying drawings.

Throughout the drawings, like reference numerals and symbols as in FIG. 1 through 5, are to be used for like parts or portions and redundant descriptions thereof are to be omitted.

Figure 6:
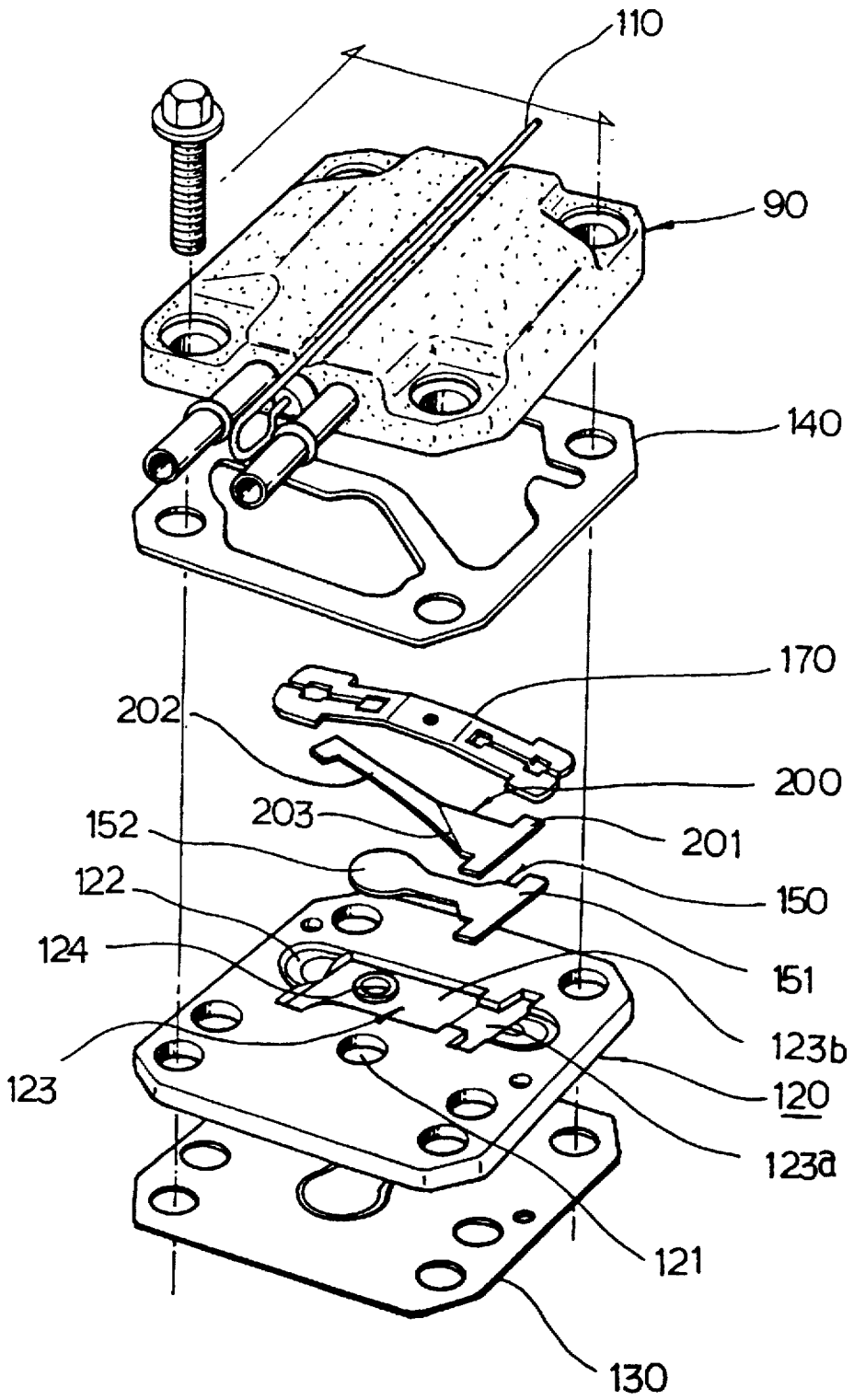
FIG. 6 is an exploded perspective view for illustrating a cylinder head according to the present invention.
Figure 7:
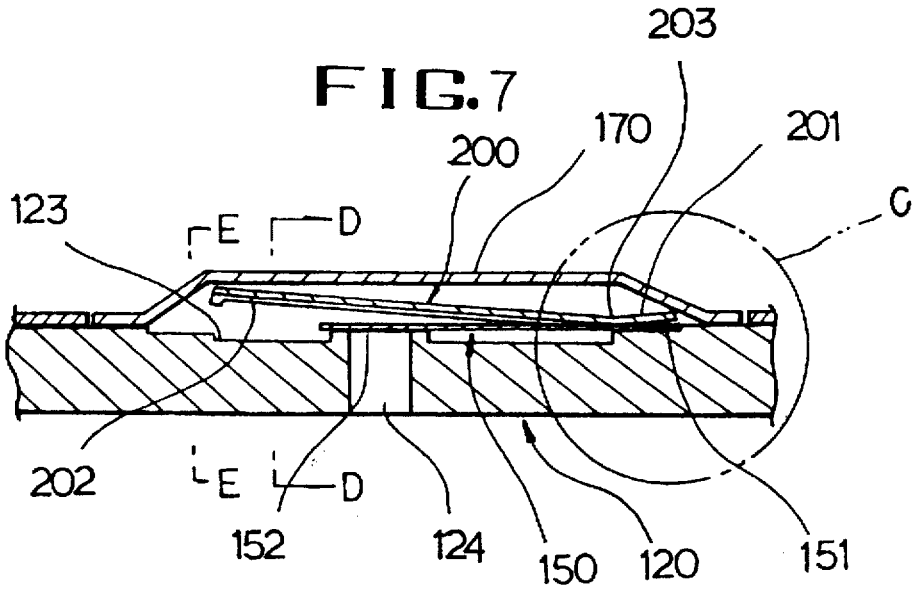
FIG. 7 is an assembled sectional view for illustrating the cylinder head according to the present invention.

As illustrated in FIGS. 6 and 7, a discharge valve plate 120 having a suction hole 121 is disposed between a cylinder block 70 and a cylinder head 90, and a suction valve plate 130 is disposed between the cylinder block 70 and the valve plate 120 so as to be opened and closed by pressure generated by high-pressurized gas when the piston 80 is moved to a bottom dead center, and gaskets 140 are respectively disposed between the cylinder head 90 and the valve plate 120 and the cylinder block 70 and the suction valve 130 to thereby prevent leakage of the high-pressurized gas.

At this time, the valve plate 120 is formed at an upper central surface thereof with a first accommodation recess 122 for accommodating a keeper member 170 so as to place a discharge valve 150 and a stopper valve 200 at a predetermined position one behind the other.

The first accommodation recess 122 is provided at a central portion thereof with a second accommodation recess 123 for accommodating the discharge valve 150 for being opened and closed by pressure generated by the high-pressurized gas discharged from the cylinder block 70 when the piston is moved to an upper dead point and at the same time for accommodating the stopper valve 200 for controlling an opening and closing domain of the discharge valve 150.

The second accommodation recess 123 is centrally formed with a discharge hole 124 for discharging the high-pressurized gas from the cylinder block 70 to the discharge chamber 92.

In other words, the second accommodating recess 123 is formed at one end thereof with a support groove **123*a* for accommodating valve fixing units 151 and 201 respectively formed at one end of the discharge valve 150 and the stopper valve 200 to allow valve movement units 152 and 202 to vertically move without being swayed laterally. Also, the recess 123 is formed at the other end thereof with a support space 123*b* so that the valve movement unit 152 of the discharge valve 150** can be smoothly and vertically opened and closed.

The stopper valve 200 includes a valve fixing unit 201 and a valve movement unit 202 for limiting an opened height of the discharge valve 150, and for preventing the vibration transmitted to the valve movement unit 152 from being transmitted to the valve fixing unit 151, and a bend unit or corner 203 disposed therebetween. The corner 203 extends at an oblique angle with respect to a longitudinal axis A of the discharge valve, as the stopper is viewed in a direction parallel to the discharge opening 124 (see FIG. 11). Thus, the bend includes a longitudinal component P and intersects a step **123*c* formed between the grooves 123*a* and 123*b* (FIG. 11). As a result of that oblique orientation, the corner attenuates vibrations of the movement unit 152 before they can be transmitted to the fixing unit 151**.

The corner 203 serves to press against a rear surface of the discharge valve 150. The movement unit 202 is positioned at a predetermined slant angle (L) relative to a plane PL of the fixing unit 151 as viewed in a direction parallel to the axis A (see FIG. 9). The free end or tip of valve movement unit 202 is positioned at a predetermined slant angle (L') relative to the plane pL and is in contact with part of the keeper member 170 as illustrated in FIG. 10.

Next, the operational effect of the present invention thus constructed will be described.

When the power is received and applied to a stator 22 of driving means 20, magnetic force is formed in a space between the stator 22 and a rotor 21, which is in turn rotated.

A crank shaft 40 is rotated by a turning effect of the rotor 21 and serves to eccentrically rotate an eccentric unit 41 formed at a lower end of the crank shaft 40 and at the same time, eccentrically rotate an oil pickup tube 50 mounted at a lower end of the eccentric unit 41.

At this time, when the oil pickup tube 50 is eccentrically rotated, the oil (0) stored in a lower case 11 is picked up by surface tension generated by a slant angle of the oil pickup tube 50 along the oil pickup tube 50 and some small portion of the oil (0) is infused into a contact surface of a connecting rod 60 and the eccentric unit 41 through an oil passage (not shown) leading to a periphery of the eccentric unit 41 to thereby reduce a frictional resistance, and another small portion of the oil (0) is infused into a contact space between the piston 80 and the cylinder block 70 through an oil passage (not shown) formed at the connecting rod 60 and the piston 80, thereby reducing a frictional resistance.

Furthermore, the oil (0) raised and picked up along a spiral groove 42 of the crank shaft 40 connected to the oil passage of an eccentric unit **30*c* and evenly dispersed on the peripheral surface of the crank shaft 40 is infused into a contact space in a bushing (not shown) fitted to be rotatively contacted to an upper and a lower end respectively against an inner diameter of the bearing 30**, to thereby reduce a frictional resistance.

Meanwhile, when the eccentric unit 41 is eccentrically rotated, the connecting rod 60 connected to the eccentric unit 41 in turn performs a horizontal reciprocating motion, and the piston 80 disposed at a tip end thereof is driven to continuously move between an upper dead center and a bottom dead center in the cylinder block 70.

In other words, when the piston 80 is moved from the upper dead center to the bottom dead center, a vacuum state is maintained in the cylinder block 70 to thereby open the suction valve 130, so that mixed gas in the suction chamber 91 at the cylinder head is sucked into the cylinder block 70 through a suction hole 121 of the valve plate 120 and the oil (0) is infused into the suction chamber 91,by way of vacuum suction force, and at the same time, is pulverized to thereafter be sucked into the cylinder block 70 with the mixed gas.

Furthermore, when the piston 80 is moved to the upper dead center, the mixed gas in the cylinder block is compressed and at the same time, the discharge valve is opened by the compression force so that the high-pressurized gas in the cylinder block 70 is discharged into the discharge chamber 92 in the cylinder head 90 through the discharge hole 124 of the valve plate 120.

In other words, when the discharge valve 150 is opened by the high-pressurized gas discharged through the discharge hole 124 of the valve plate 120, the valve movement unit 152 of the discharge valve 150 hits the valve movement unit 202 of the stopper valve 200 to thereby be restricted in its opened angle and to permit a discharge of the high-pressurized gas.

Figure 8:
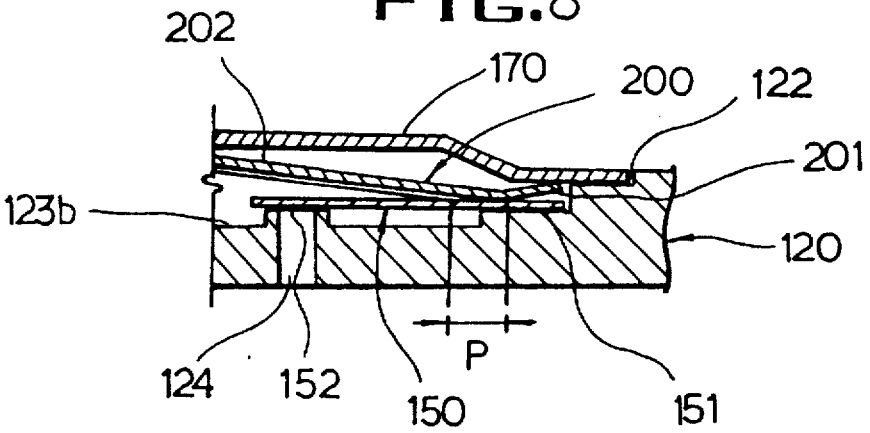
FIG. 8 is an enlarged schematic drawing of section "C" according to the present invention.

When the discharge of the high-pressurized gas is finished, the discharge valve 150 is closed by a resilient force of the bend unit 203 of the stopper valve 200 and by a restoring force of the discharge valve 150 itself, thereby closing the discharge hole 124 of the valve plate 120. At this time, the corner 203 having the longitudinal component "P" illustrated in FIG. 8 and 11 intersects the step 123*c* and serves to perform a spring contact role between the valve movement unit 152 of the discharge valve 150, and the valve fixing unit 151, and play a role of damping or attenuating the vibration of the movement unit 152 before it reaches the fixing unit 151.

Figure 9:
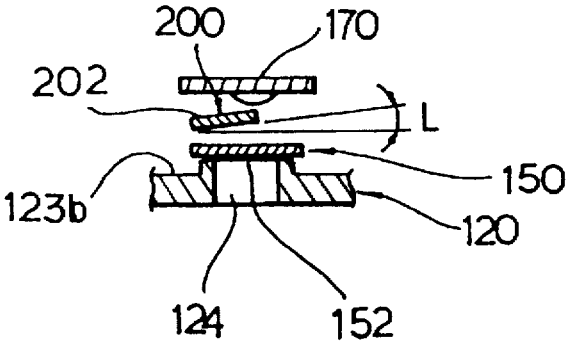
FIG. 9 is a sectional view taken along line 9—9 in FIG. 7.
Figure 10:
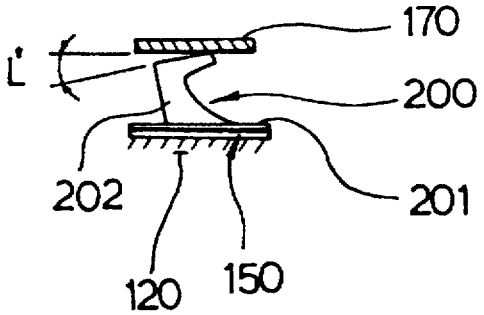
FIG. 10 is a sectional view taken along line 10—10 in FIG. 7.

The slant angles L and L' illustrated in FIGS. 9 and 10 cause the stopper valve 120 to be contacted by the discharge valve 150 for a few seconds after the discharge valve 150 is opened so that the contact period between the discharge valve 150 and the stopper valve 200 is lengthened and the trembling phenomenon of the discharge valve 150 can be reduced and at the same time the transmission of vibration to the valve fixing unit 151 can be attenuated.

Accordingly, the corner 203 serves to press against the valve fixing unit 151 of the discharge valve 150 to cause the same to be tightly engaged against the support groove 123*a* of the valve plate 120 to thereby attenuate the trembling phenomenon and prevent it from being transmitted to the valve fixing unit 151.

The slant angles L and L' illustrated in FIGS. 9 and 10 serve to lengthen the contact period between the discharge valve 150 and the stopper valve 200 can be lengthened, so that valve movement can be stabilized, and irregular movement generated by valve vibration can be eliminated to thereby improve valve performance and to reduce noise.

As is apparent from the foregoing there is an advantage in the valve apparatus according to the present invention, in that a corner is obliquely and slantly formed between a valve fixing unit and a valve movement unit of a stopper valve to thereby make the corner tight press against a valve fixing unit of a discharge valve, so that the generation of vibration to a valve fixing unit can be attenuated, whereby valve movement can be further stabilized, valve performance can be improved and noise can be reduced.

What is claimed is:

1. A valve apparatus adapted for use in a reciprocating compressor which pressurizes gas, the valve apparatus comprising:

a valve plate having a gas discharge opening for discharging pressurized gas, and a discharge valve; the discharge valve including a fixing portion and a movement portion normally assuming a closed position covering the discharge opening; the movement portion being flexible rearwardly relative to the fixing portion to an open position uncovering the discharge opening in response to a force of pressurized gas; and a stopper disposed behind the discharge valve for limiting an opening angle of the movement portion in its open position; the stopper including a first portion disposed behind the fixing portion of the discharge valve, and a second portion disposed behind the movement portion of the discharge valve and being bent relative to the first portion to define a corner engaging the discharge valve; the corner extending obliquely relative to a longitudinal axis of the discharge valve as the stopper and discharge valve are viewed in a direction parallel to the discharge opening, wherein the second portion is slanted at an inclination relative to a plane of the fixing portion of the discharge valve as viewed in a direction parallel to the longitudinal axis of the discharge valve.

2. The valve apparatus according to claim 1, wherein a section of the valve plate disposed in front of the movement portion is spaced forwardly of a section of the valve plate disposed in front of the fixing portion, those sections forming a step therebetween, the corner of the stopper intersecting the corner as the stopper is viewed in said direction.

3. The valve apparatus according to claim 1, further including a keeper disposed behind the stopper for maintaining the first portion of the stopper in contact with the fixing portion of the discharge valve.

* * * * *